United States Patent [19]

Dawson

[11] 4,080,096

[45] Mar. 21, 1978

[54] FLUID PUMP IMPELLER

[76] Inventor: Edward S. Dawson, 2927 Hillsboro Ave. North, Minneapolis, Minn. 55427

[21] Appl. No.: 701,808

[22] Filed: Jul. 1, 1976

[51] Int. Cl.[2] ..... F04D 3/00

[52] U.S. Cl. ..... 415/213 C; 415/209; 415/215; 416/176; 416/188

[58] Field of Search ..... 415/209, 210, 213 C, 415/213 R, 215, 191; 416/176, 177, 188; 115/12 R; 29/156.8 CF

[56] References Cited

U.S. PATENT DOCUMENTS

| | | | |
|---|---|---|---|
| 1,408,715 | 3/1922 | Seelig et al. | 415/210 |
| 1,683,949 | 9/1928 | Bergdoll | 415/209 |
| 1,874,450 | 8/1932 | Coats | 415/209 |
| 1,971,386 | 8/1934 | Schmidt | 415/210 |
| 1,981,991 | 11/1934 | Cline et al. | 415/210 |
| 2,127,747 | 8/1938 | Luther | 415/191 |
| 2,276,827 | 3/1942 | Damonte | 415/215 |
| 2,449,531 | 9/1948 | Lee, Jr. | 416/177 |
| 2,985,952 | 5/1961 | Nutter et al. | 416/188 |
| 3,442,220 | 5/1969 | Mottram et al. | 415/213 R |
| 3,561,392 | 2/1971 | Baez | 115/12 R |

*Primary Examiner*—C. J. Husar

*Attorney, Agent, or Firm*—Orrin M. Haugen

[57] ABSTRACT

An axial flow pump structure utilizing an impeller of improved design, constituting essentially a propeller blade delivering forces to the fluid either gaseous or liquid being pumped in both axial and centrifugal modes. The blade is an evolute wherein the evolute is defined as the path on a sphere traced out by a point starting at longitude 0° latitude (90 minus $\alpha$)° and having at any time the position longitude $\phi$° latitude (90 minus X)°, where $\phi$ and X are given as functions of $\theta$ by $\text{Cos X} = \text{Cos } \alpha \text{ Cos } (\theta \text{ Sin } \alpha)$;

$$\text{Cox } (\theta - \phi) = \tan \alpha \cot X \text{ and;}$$

$\theta$ increases from zero to (90 cosec $\alpha$)° as the evolute descends to the equator of the sphere. The impeller may be utilized with a diffuser employed downstream from the impeller, with the diffuser having a configuration which is defined generally by the same equation as defines the evolute of the blade, however the diffuser blades are disposed in an axial relationship which is opposite to that disposition of the blades forming the impeller to obtain substantially linear flow.

8 Claims, 5 Drawing Figures

FLUID PUMP IMPELLER

BACKGROUND OF THE INVENTION

The present invention relates generally to an improved axial flow pump, and more particularly to such a pump having an impeller delivering forces to the fluid which are combined in both the axial and centrifugal direction.

It has been found that the performance of such a pump is improved, with greater overall efficiency being delivered. In this connection, the overall efficiency is the standard definition of the term, being the ratio of the energy delivered by the pump to energy supplied to the input side of the pump driver.

The improved impeller design of the present invention makes it possible to employ the pump in a variety of applications. However, the performance of the pump appears to be at its highest level when the pump is being utilized to deliver its volumetric capacity at high pressures. The performance of the pump is particularly enhanced when dealing with compressible fluids such as air or other gases, it having been ascertained that the performance capability or efficiency of the pump increases as the output of the pump increases in terms of its output pressure and volumetric capacity. In other words, the performance of the pump increases with increasing static pressure at the output. As will be explained in greater detail hereinafter, however, there are impeller designs consistent with the present invention which permit application of the device to systems wherein the output pressure is high.

Because of the design of the structure, it is possible to employ the pump in solutions carrying suspended solids. Furthermore, it is possible to employ the pump in systems wherein stones, rocks, sand or the like may be present, with the design being arranged to accommodate and pass such obstructions when present. It is possible to employ the structure for both liquid and gaseous fluids, with the arrangement being suited for both such fluids.

SUMMARY OF THE INVENTION

Briefly, in accordance with the present invention, an axial flow pump is provided which utilizes an impeller within a tubular casing, and with the impeller having both end and elevational profiles which are substantially circular in configuration. The individual impeller blades are mounted upon a cone member which is concentric with the drive shaft, and the number of blades forming the impeller, as well as their geometrical configuration, is such that both end and elevational profiles of the finished structure are substantially circular. Briefly, as the number of blades forming the impeller increases, the cone angle of the subtending cone correspondingly increases, thereby preserving the circular configuration for both profiles. As has been indicated, the blades of the impeller constitute a structure which may be described as follows:

It is the ruled surface whose generators all pass through the center O of a sphere and meet the sphere in the involute ST. This involute is the path of the end of an inextensible, but flexible, string which unwinds from the circle of constant latitude $(90 - \alpha)°$, which end passes from S on this circle, stays on the surface of the sphere keeping the string taut and finally reaches T on the equator. The ruled surface can be made by bending up a segment of a circle, the angle of this segment, $\gamma$, being related to the angle $\alpha$ in the above description. If M blades are to be made from a flat circle $\alpha$ should be chosen from by the following table:

| M | 2 | 3 | 4 | 5 | 7 |
|---|---|---|---|---|---|
| $\alpha$ | 17.7 | 25.5 | 32.5 | 38.5 | 48.1 |

The pump may include a diffuser plate downstream from the impeller assembly which utilizes blades having a configuration which may be similar to that of the impeller blades, or otherwise, but arranged in oppositely disposed angular relationship to the rotating impeller so as to provide linear flow at the diffuser outlet. The impeller is preferably mounted on a core having a configuration such as a truncated cone, with the cone having a cone angle which is determined essentially from the number of blades comprising the impeller assembly, with this cone angle being that angle from which the surface of the cone extends from the shaft axis, and diverges in the direction taken from the impeller inlet toward the impeller outlet. Preferably, the diffuser plates are mounted on a core which may be a sleeve of constant diameter forming a continuation of the impeller core, with the diffuser utilizing plates, as previously indicated, which are skewed in a direction counter to that induced in the fluid by rotation of the impeller blades.

Therefore, it is a primary object of the present invention to provide an improved axial flow pump having an impeller utilizing blades of improved design for providing enhanced efficiency to the device.

It is yet a further object of the present invention to provide an improved axial flow pump having an impeller and diffuser structure which are complementary, one to another, the combined impeller and diffuser design providing a pump having enhanced operating efficiency.

Other and further objects of the present invention will become apparent to those skilled in the art upon a study of the following specification, appended claims, and accompanying drawings.

DESCRIPTION OF THE PREFERRED EMBODIMENT

Figure 1:
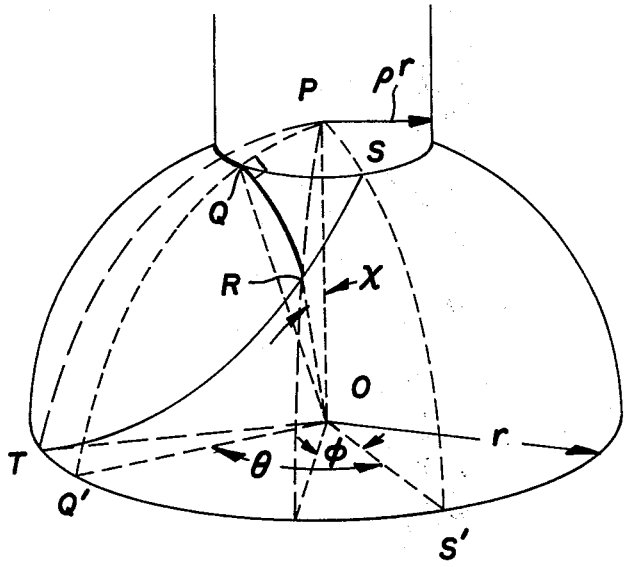
FIG. 1 is a perspective view of the evolute of the surface generated in the formation of an impeller blade for use in the structure of the present invention.

In accordance with the preferred embodiment of the present invention, and with particular attention being directed to FIG. 1 of the drawings, the following definitions apply:

The surface of the blade can be succinctly described as follows:

"That certain evolute which is 'the path on a sphere traced out by a point starting at Long. 0° Lat (90 − α)° and having at any time the position Long. $\phi$° Lat (90 − X)° where $\phi$ and X are given as function of $\theta$ by $$, \operatorname{Cos} X = \operatorname{Cos} \alpha \operatorname{Cos} (\theta \operatorname{Sin} \alpha)$$

$$, \operatorname{Cos} (\theta - \phi) = \tan \alpha \operatorname{Cot} x$$

and $\theta$ increases from 0 to (90 Cosec α)° as the evolute descends to the equator of the sphere.'"

By way of further definition, and with particular attention being directed to FIG. 1 of the drawings, the following definitions appear appropriate:

*O* is the center of the sphere;
*P* is the pole of the sphere;
*Q* is current position of point of tangency of string;
*R* is current position of end of string;
*S* is starting position of end of string;
*T* is terminating position of end of string on the equator;
Q', R', S' are equational points of the same longitude as Q, R, S respectively.

The angles are:

$\theta$ = Q'OS'; $\phi$ = R'OS'; $X$ = ROP; $\alpha$ = POQ = $\sin^{-1} p$

Radius of sphere is $r$; radius of cylinder = $pr$, $p<1$.

The current position of the end R is given by $\phi$ and X.

Since PQR is a spherical triangle with angles $PQR - 90°$; $QPR = \theta$ minus $\phi$ and sides $PQ = \alpha$, $PR = X$ and $QR = p\,\theta$ we have $$, \cos X - \operatorname{Cos} \alpha \operatorname{Cos} p\,\theta \qquad (1)$$

and $\operatorname{Cos} P\theta = \operatorname{Cos}\alpha \operatorname{Cos} X + \sin\alpha \sin X \operatorname{Cos} (\theta - \phi)$ i.e.

$$, \operatorname{Cos} (\theta - \phi) = \tan \alpha \cot X \qquad (2)$$

Since $\alpha$ is constant, (1) and (2) serve to express $X$ and $\phi$ in terms of $\theta$.

When $\theta = 0$, $X = \alpha$, $\phi = 0$ as should be the case when $X = 90°$, $p\theta = 90°$ and $\theta - \phi = 90°$ i.e.

$$, \phi = \theta - 90° = 90° (1 - p/\rho)$$

Let $\beta$ denote the value of $\phi$ when $X = 90°$. Then from equation (1), $X = 90°$ implies $p\,\theta = 90°$ and equation (2) then implies that $\theta - \phi = 90°$. Hence $\beta$, the value of $\phi$ at this point, is $$\beta = \frac{1-p}{p} 90° = (\operatorname{cosec} \alpha - 1) \frac{\pi}{2} \text{ radians.}$$

The segment of the equatorial plane that can just be bent up into the surface OST subtends an angle $\gamma$ given by:

$$\gamma = \int_{\alpha}^{2} \sqrt{1 + \sin^2 X \left(\frac{d\phi}{dX}\right)^2}\, dX \text{ (X and } \phi \text{ in radians)}$$

But from differentiation of equations (1) and (2), we have $$\frac{dX}{d\theta} = \operatorname{Cos} \alpha \operatorname{Sin} \alpha \operatorname{Cosec} X \sin (\theta \sin \alpha)$$

-continued $$\frac{d\phi}{d\theta} = 1 - \cot (\theta - \phi) \sec X \operatorname{cosec} X \frac{dX}{d\theta}$$

Hence after some manipulation:

$$\gamma = \frac{1}{\sin \alpha} \int_{\alpha}^{\frac{\pi}{2}} \sin X dX = \operatorname{Cot} \alpha \text{ (rads)} = \left(\frac{180}{\pi} \cot \alpha\right)^{o}$$

Therefore, it would appear that the parametric equation set forth herein are those which provide the curvature of the desired blade configuration of the present invention.

For example, the following table identified as Table I provides for the structure to be utilized if M blades are to be made from a complete circle, the table being as follows:

TABLE I

| M | 1 | 2 | 3 | 4 | 5 | 6 | 7 | 8 | 9 | 10 |
|---|---|---|---|---|---|---|---|---|---|---|
| α | 9.04 | 17.7 | 25.5 | 32.5 | 38.5 | 43.7 | 48.1 | 51.9 | 55.1 | 57.9 |
| β | 482.6 | 206.7 | 118.9 | 77.6 | 54.5 | 40.3 | 30.9 | 24.4 | 19.8 | 16.3 |
| γ | 360 | 180 | 120 | 90 | 72 | 60 | 51.4 | 45 | 40 | 36 |

Figure 5:
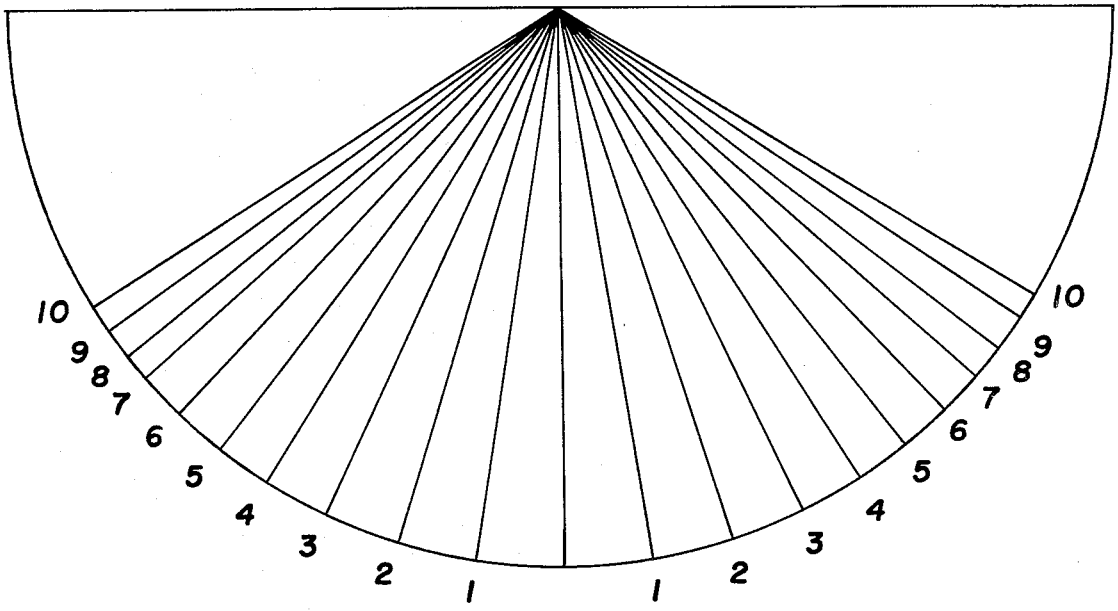
FIG. 5 is a drawing illustrating the relationship between the cone angle and the number of blades utilized to form the impeller assembly.

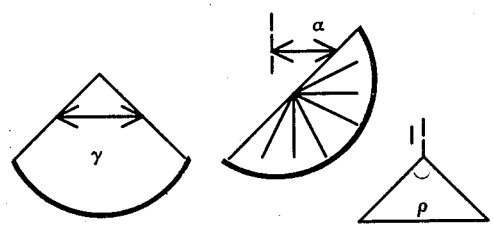

α = cone angle in degrees (See also FIG. 5);
γ = 360° /M or blade angle;
β = is the angle in degrees that the projection of the surface occupies.

While only designs for up to 10 blades are shown, there may be assemblies prepared which utilize more than 10 blades, and their relationships may be calculated from the above data.

Figure 2:
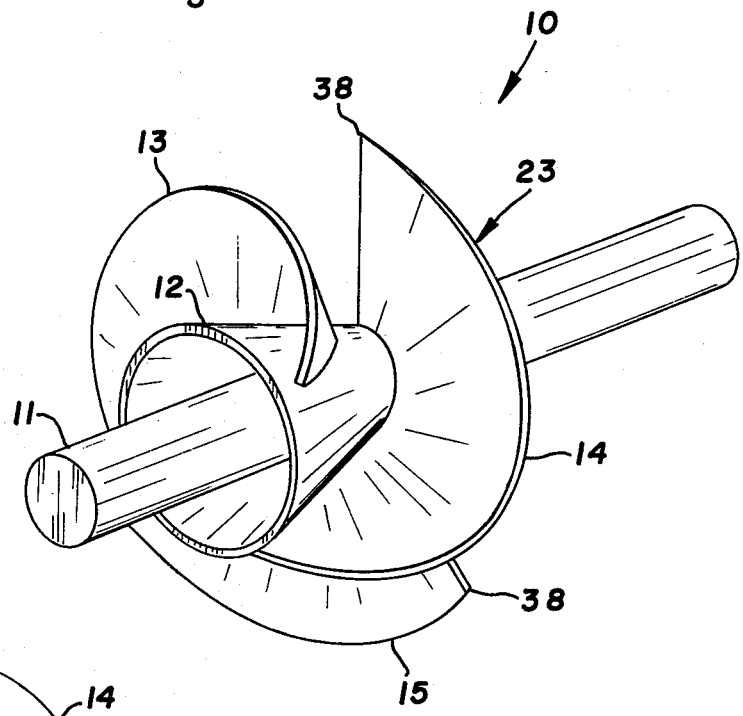
FIG. 2 is a perspective view of an impeller having three arcuately spaced blades which have a configuration defined by the evolute of FIG. 1.
Figure 3:
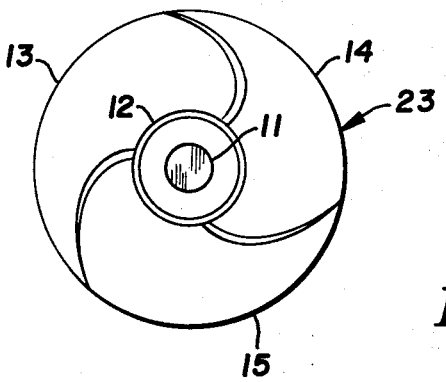
FIG. 3 is an end view of the device illustrated in FIG. 2, and showing the full circle profile of the blades utilized to form the impeller structure.

Attention is now directed to FIGS. 2 and 3 of the drawings wherein an impeller assembly structure is illustrated, and wherein the impeller is provided with three blades each being designed from the evolute of FIG. 1. Specifically, the impeller generally designated 10 includes a shaft portion 11 having a flared or conical portion as at 12, and having a plurality of blades thereon as shown at 13, 14 and 15. Each of the blades 13, 14 and 15 are identical, one to the other, and hence only one will be described in detail. It will be observed, of course, that each of the blades 13, 14 and 15 is formed consistent with the evolute of FIG. 1.

The conical portion 13 has a cone angle of approximately 25.5°. It has been found for most purposes that this angular relationship, as set forth in detail in Table I hereinabove, is preserved for enhancing the pumping of both compressible and incompressible fluids, including air and other compressible gases, and further including water and other incompressible fluids. For most purposes, the impeller can be utilized for compressible fluids such as water containing suspended solids. Viscosity characteristics of other fluids may require an increase or decrease in this cone angle for optimization, however a cone angle as set forth in Table I has been found appropriate for most pumping applications.

While the values for the cone angle as set forth in Table I are representative for most applications, such as for universal applications, these cone angles may be varied to a certain extent depending upon the ultimate use or application of the impeller. For compressible fluids, for example, if one were to increase the cone angle beyond that value given in Table I, higher pressures would result from the use of the device, and conversely, if the cone angle were decreased, lower output pressures would be expected to be developed. It will be apparent, therefore, that any modification or deviation of the cone angle will correspondingly disturb the circular cross-sectional features described hereinabove, it will be further appreciated that any such disturbing of these profiles will not detract significantly from the operation of impeller. Therefore, the values set forth for the cone angle in Table I are representative for the design of impellers having universal application, it being appreciated that some departure may be made without destroying the utility of the device.

Figure 4:
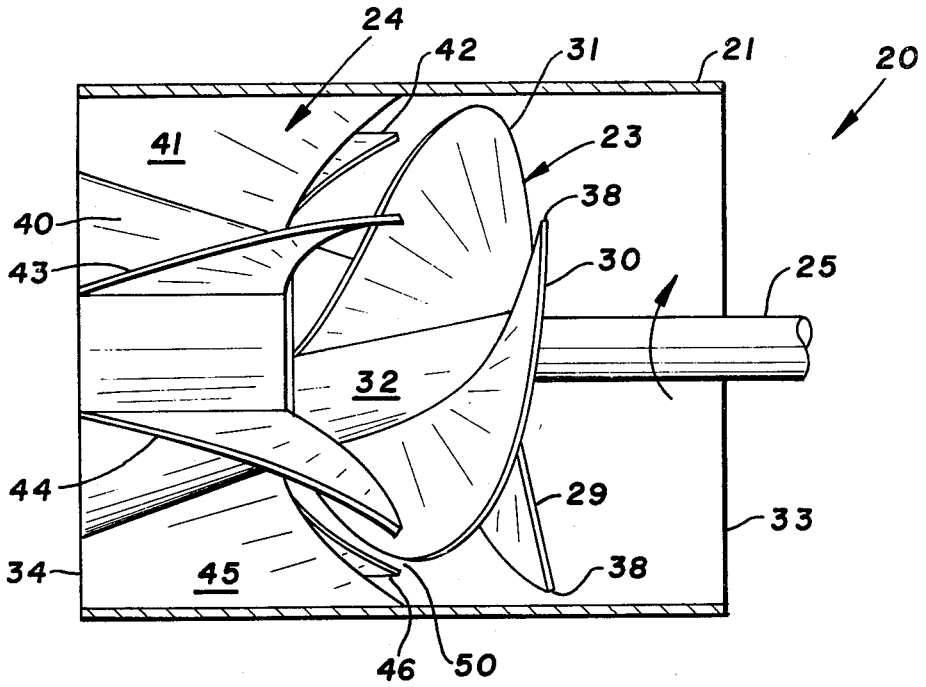
FIG. 4 is a side elevational view of a combined impeller and diffuser plate made in accordance with the present invention.

Attention is now directed to FIG. 4 of the drawings wherein an entire pump structure is illustrated. In FIG. 4, the pump, which is an axial flow pump, generally designated 20 includes a casing 21, along with an impeller assembly generally designated 23 and a diffuser generally designated 24. Power is provided to impeller 23 through shaft 25 which is retained in a conventional bushing and journal (not shown). Impeller assembly 23 includes blades 29, 30 and 31 which are secured to shaft 25 and also to truncated cone member 32. The blades 29, 30 and 31 of impeller 23 are identical to blades 13, 14 and 15 of the structure of FIG. 2.

As is apparent in FIG. 4, the casing (comprising housing segment 21) has an inlet as at 33 and an outlet as at 34. Impeller 23 and diffuser 24 are cooperatively arranged within the confines of the casing which is a tubular member arranged around to exterior of the impeller.

With attention being continued to be directed to FIGS. 2–4 of the drawings, the details of impeller assembly 23 will be illustrated. It will be seen that impeller assembly 23 includes three blade members, with each blade having a generally circular cross-sectional profile, and which includes a leading zone or point, for example, as illustrated at 38 in FIG. 2. Each of the blades extend in continuation of the evolute of FIG. 1. It is this configuration which is believed to provide for the combined axial and centrifugal forces being applied to the fluid being pumped, thereby contributing to a greater degree of operating efficiency.

The elevational view illustrated in FIG. 4 shows the inlet face of the diffuser 24. As is apparent, diffuser 24 employs a generally centrally disposed truncated cone 40 upon which are mounted diffuser blades 41, 42, 43, 44, 45 and 46. Each of these diffuser blades has a profile which is complementary to and symmetrical with that of the impeller blades, with the distinction being, however, that they are disposed at an opposite arcuate angle to that of the impeller blades. Also, it will be observed that truncated member 40 extends in continuation of truncated member 30 of FIGS. 2 and 4.

With attention now being directed to FIG. 4, it will be appreciated that a clearance exists between the rear surfaces of impeller blades 29, 30 and 31, and the leading surfaces of vanes or blades 41–46, with this clearance being illustrated at 50. The clearance is generally greater than the cross-sectional size of solid articles which may be introduced into the flowing fluid. It will be noted, however, that it is a feature of this pump to be able to pass solid obstructions therethrough even when the size may exceed the dimension of the clearance 50. This is due to the inverse relationship of the curves of the skewed vanes 41–46 and that of the impeller blades such as blades 29, 30 and 31. Preferably, for most purposes, from one to 10 such blades may be employed for practical pump structures.

By way of application of the structures to specific operations, an impeller designed for use in connection with a jet propelled boat, for example, will preferably utilize a larger number of impeller blades, such as, from between five and seven blades in order to achieve the flow desired along with the higher pressures. Conversely, if one were to employ a pump as an impeller of this type for a transfer pump or other high capacity low pressure application, then, in such an event, one may employ an impeller having only one or two blades. Such an impeller design will provide for reasonably high capacity, but only modest pressure performance.

I claim:

1. In an axial flow pump, an impeller and means mounting said impeller for axial rotation;

a. said impeller comprising a rotor shaft and at least one impeller blade secured thereto for rotation therewith;

b. said impeller blade comprising blade means with a profile being an evolute defined substantially as the path on the surface of a sphere traced out by a point starting at longitude 0° latitude (90 minus X)° and having at any time the position longitude $\phi$° latitude (90 minus X)°, where $\phi$ and X are given substantially as functions of $\theta$ by:

$\text{Cos } X = \text{Cos } \alpha \text{ Cos } (\theta \text{ Sin } \alpha)$;

$\text{Cos } (\theta \text{ minus } \phi) = \tan \alpha \cot X$; and $\theta$ increases from 0 to (90 cosec $\alpha$ )° as the evolute descends to the equator of the sphere, and wherein $\theta$ is the arcuate angle between the starting point and the position point.

2. The axial flow pump as defined in claim 1 being particularly characterized in that said impeller blades are mounted on a truncated conical core having an angle from the axis of said shaft and diverging from inlet to outlet, wherein the cone angle of said truncated conical core, together with the configuration of said impeller blades forms elevational and end profiles which are substantially circular.

3. The axial flow pump as defined in claim 1 being particularly characterized in that said impeller is provided with equally arcuately spaced blades totalling from one to ten in number.

4. The axial flow pump as defined in claim 1 being particularly characterized in that a diffuser is disposed between said impeller and said outlet.

5. The axial flow pump as defined in claim 2 being particularly characterized in that diffuser means are disposed between said impeller and said outlet, with said diffuser comprising a plurality of generally axially extending blades, and wherein said axially extending diffuser blades are mounted on a truncated conical core extending in continuation of the said truncated conical core of said impeller.

6. The axial flow pump as defined in claim 5 being particularly characterized in that said diffuser blades comprise skewed vanes disposed counter to the skew of said impeller blades upon rotation so as to provide substantially lineal output flow from said diffuser blades.

7. The axial flow pump as defined in claim 5 being particularly characterized in that the leading edge of said diffuser blades is arranged complementary to the trailing edge of said impeller blades.

8. The axial flow pump as defined in claim 1 being particularly characterized in that said pump includes a housing defining a pumping chamber with an inlet and an outlet, and wherein said housing is disposed generally coaxially about said rotor shaft.

* * * * *